US010115325B2

(12) United States Patent
Scaturro et al.

(10) Patent No.: US 10,115,325 B2
(45) Date of Patent: Oct. 30, 2018

(54) SYSTEM TO DISPLAY A FLAG AND METHOD TO MANUFACTURE THE SYSTEM

(71) Applicant: C J Limited LLC, Valrico, FL (US)

(72) Inventors: Anthony Scaturro, Valrico, FL (US); Paul Donahue, North Wales, PA (US); Randy Mepplelink, Holland, MI (US); David Daugherty, Zeeland, MI (US)

(73) Assignee: CJ Limited LLC, Valrico, FL (US)

( * ) Notice: Subject to any disclaimer, the term of this patent is extended or adjusted under 35 U.S.C. 154(b) by 146 days.

(21) Appl. No.: 15/179,244

(22) Filed: Jun. 10, 2016

(65) Prior Publication Data

US 2016/0284254 A1 Sep. 29, 2016

Related U.S. Application Data

(63) Continuation-in-part of application No. 13/647,535, filed on Oct. 9, 2012.

(60) Provisional application No. 61/560,027, filed on Nov. 15, 2011.

(51) Int. Cl.

| | |
|---|---|
| ***G09F 17/00*** | (2006.01) |
| ***G09F 11/08*** | (2006.01) |
| ***G09F 11/21*** | (2006.01) |
| ***G09F 11/30*** | (2006.01) |

(52) U.S. Cl.

CPC ..... *G09F 17/00* (2013.01); *G09F 11/08* (2013.01); *G09F 11/21* (2013.01); *G09F 11/30* (2013.01); *G09F 17/0091* (2013.01); *G09F 2017/0025* (2013.01); *G09F 2017/0041* (2013.01); *Y10T 29/49117* (2015.01); *Y10T 29/49826* (2015.01)

(58) Field of Classification Search

CPC ..... G09F 17/00; G09F 11/08; G09F 17/0091; G09F 2017/0025; G09F 11/21; G09F 11/30; G09F 2017/008; G09F 2017/0041; G09F 2017/005; G09F 2017/0066; Y10T 29/49117; Y10T 29/49826

USPC ..... 116/28 R, 173–175, 209; 40/218, 591, 40/602, 607.01, 470, 514–515

See application file for complete search history.

(56) References Cited

U.S. PATENT DOCUMENTS 2,307,095 A * 1/1943 Zaferakis ..... E06B 9/60 160/263
2,460,307 A * 2/1949 Pidgeon ..... E06B 9/60 160/313
2,506,209 A * 5/1950 Glass ..... G09F 17/00 160/23.1
2,579,563 A * 12/1951 Gallinger ..... B65H 54/78 226/118.4

(Continued)

*Primary Examiner* — R. A. Smith
*Assistant Examiner* — Tania Courson

(57) ABSTRACT

A system to display a flag and a method of manufacturing the flag display system are described. The system includes an attachment member configured to affix the system to a structure horizontally, vertically, or at an angle in between. The system also includes a flag housing configured to house a flag, the flag housing being coupled to the attachment member, a roller member disposed in the flag housing, the flag being disposed to roll onto and off of the roller member to be stored or displayed, respectively, and a guide member coupled to the roller member at a first end in the flag housing, the guide member being configured to maintain alignment between the flag and the roller member when the flag is rolled onto and off of the roller member.

21 Claims, 8 Drawing Sheets

(56) References Cited

U.S. PATENT DOCUMENTS 3,675,616 A * 7/1972 McInnis ..... G09F 17/00 116/173
3,678,456 A * 7/1972 Gruber ..... B60Q 7/00 116/28 R
3,996,882 A * 12/1976 Martin ..... G09F 17/00 116/173
4,332,201 A * 6/1982 Pollard ..... B61F 3/04 105/167
4,332,210 A * 6/1982 Lambert ..... G09F 17/00 116/173
4,406,447 A * 9/1983 Fichte ..... B65H 7/02 271/110
4,557,372 A * 12/1985 Rajagopal ..... B65G 39/16 198/807
4,558,862 A * 12/1985 Kelly ..... G01P 13/02 116/173
4,794,715 A * 1/1989 Cherwin ..... B60J 1/2019 40/514
4,800,834 A * 1/1989 Feng ..... E04H 12/182 116/173
4,972,794 A * 11/1990 Smyly, Sr. ..... E04H 12/32 116/173
5,042,419 A * 8/1991 Bianco ..... A62B 99/00 116/173
5,044,417 A * 9/1991 Bresson ..... E06B 9/72 160/1
5,123,474 A * 6/1992 Smith ..... E06B 9/13 160/273.1
5,462,105 A * 10/1995 Supernak ..... E06B 9/323 160/238
5,500,090 A * 3/1996 Autio ..... D21F 1/365 162/200
5,803,150 A * 9/1998 Boiteau ..... E04F 10/0648 160/310
6,155,018 A * 12/2000 Yang ..... G09F 17/00 116/174
8,621,771 B2 * 1/2014 Amalaha ..... F04D 17/04 116/173
8,813,674 B2 * 8/2014 Tait ..... G09F 17/00 116/173
2004/0045683 A1 * 3/2004 Carrillo ..... E04F 10/0614 160/310
2006/0109651 A1 * 5/2006 Cocciardi ..... F21V 21/088 362/253
2006/0124796 A1 * 6/2006 Morgan ..... G09F 11/08 242/390.8
2012/0031567 A1 * 2/2012 Shier ..... E06B 9/68 160/1
2012/0167815 A1 * 7/2012 Tait ..... G09F 17/00 116/173
2013/0118044 A1 * 5/2013 Scaturro ..... G09F 11/21 40/515
2018/0047317 A1 * 2/2018 Mahedy ..... G09F 11/08

* cited by examiner

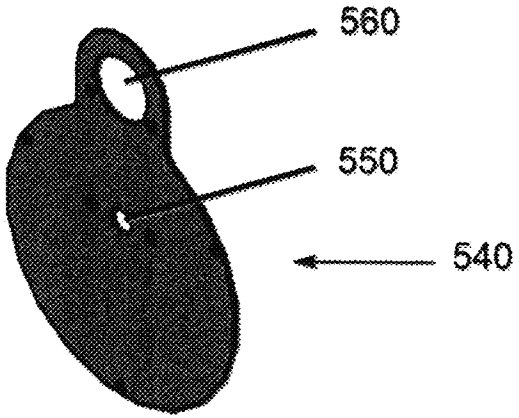
FIG. 9
End Plate
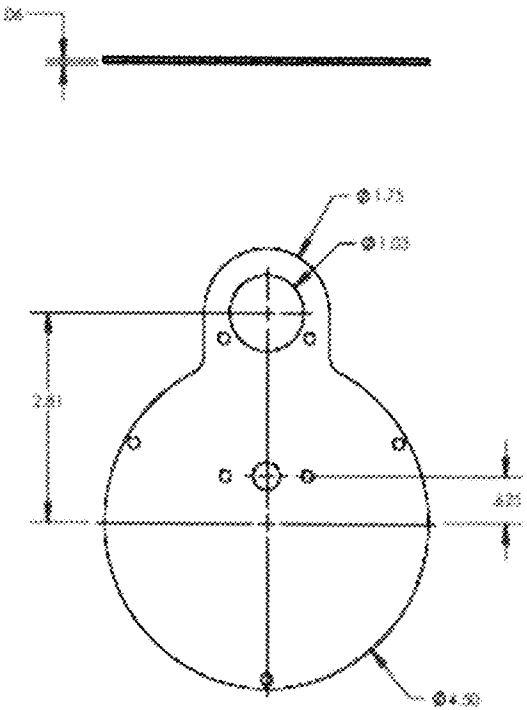

SYSTEM TO DISPLAY A FLAG AND METHOD TO MANUFACTURE THE SYSTEM

CROSS-REFERENCE TO RELATED APPLICATION

This application is a continuation-in-part of U.S. patent application Ser. No. 13/647,535, filed Oct. 9, 2012, which claims priority to Provisional Patent Application Ser. No. 61/560,027 filed Nov. 15, 2011, the disclosures of which are each hereby incorporated by reference herein in their entireties.

BACKGROUND OF THE INVENTION

The subject matter disclosed herein relates to displaying a flag.

Individuals and businesses display flags on a regular basis. Typically, flags are displayed on vertical masts or ones that make a forty-five degree angle with a vertical structure, such as an exterior wall of a home. When flags are left outdoors during weather conditions such as rain, heavy winds, and dust storms, the condition of the flag material can deteriorate. Preventing this deterioration has required frequent and inconvenient removal and resetting. Thus, a convenient and effective way to display a flag over a long period of time would be appreciated.

BRIEF DESCRIPTION OF THE INVENTION

According to an aspect, a system to display a flag includes an attachment member configured to affix the system to a structure horizontally, vertically, or at an angle in between; a flag housing configured to house a flag, the flag housing being coupled to the attachment member; a roller member disposed in the flag housing, the flag being disposed to roll onto and off of the roller member to be stored or displayed, respectively; and a guide member coupled to the roller member at a first end in the flag housing, the guide member being configured to maintain alignment between the flag and the roller member when the flag is rolled onto and off of the roller member.

According to another aspect, a method to manufacture a flag display system includes coupling a flag housing to an attachment member, the attachment member including an attachment portion to affix the flag display system to a structure horizontally, vertically, or at an angle therebetween; disposing a roller member in the flag housing, the roller member configured to roll a flag into and out of the flag housing; and positioning a guide member coupled to the roller member at a first end of the flag housing, the guide member including a notched portion and the attachment portion being disposed at an opposite end of the attachment member from the first end.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 9 depicts an exemplary embodiment of an end plate element for use with the invention as herein described.

The detailed description explains embodiments of the invention, together with advantages and features, by way of example with reference to the drawings.

DETAILED DESCRIPTION OF THE INVENTION

Figure 1:
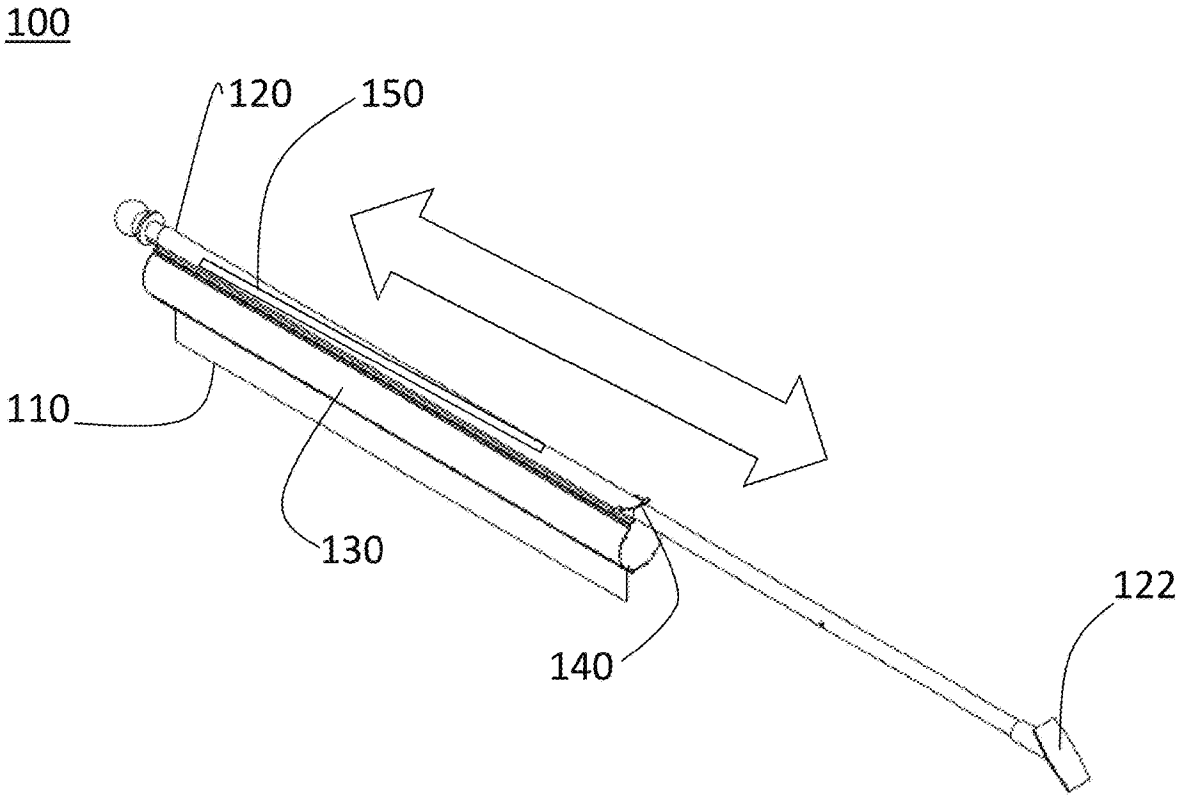
FIG. 1 depicts a system to display a flag according to an embodiment of the invention.

FIG. 1 depicts a system 100 to display a flag 110 according to an embodiment of the invention. The attachment member 120 affixes the system 100 to a structure (not shown) such as, for example, a building or a ground mount. The attachment portion 122 of the attachment member 120 may pivot in various embodiments to allow attachment of the system 100 at various angles against the structure. For example, a typical arrangement is one in which the system 100 is attached at the attachment portion 122 such that the flag 110 is flying at a forty-five degree angle. The attachment member 120 in the embodiment of FIG. 1 is essentially a rod with a base (attachment portion 122) that serves as the point at which the attachment member 120 is affixed to the structure. Exemplary types of fasteners to affix the attachment member 120 to a building or other structure include screws, nails, and adhesives. The attachment member 120 is coupled to a flag housing 130 that houses the flag 110.

The flag housing 130 is configured to move along the axial span of the attachment member 120 as indicated by the arrows. The movement may be achieved manually through adjustment of a holding member 140. The holding member 140 may be, for example, a u-bolt that can be loosened to allow movement of the flag housing 130 and then retightened. In alternate embodiments, electronic control may be employed to move the flag housing 130 along the axial span of the attachment member 120. This electronically controlled movement may be achieved through a push of a button by an operator or via a remote instruction in various embodiments. By the various embodiments of the holding member 140, the flag 110 may be flown at half-mast (i.e., flag housing 130 is half way between the attachment portion 122 and the other end of the attachment member 120, referred to herein as the top end of the system 100) or at full-mast (i.e., flag housing 130 at the top end of the system 100) or in some other position determined by the user. One or more lights 150 may be mounted on the attachment member 120 and will be discussed further with reference to the light controller 250 (FIG. 2) below.

Figure 2:
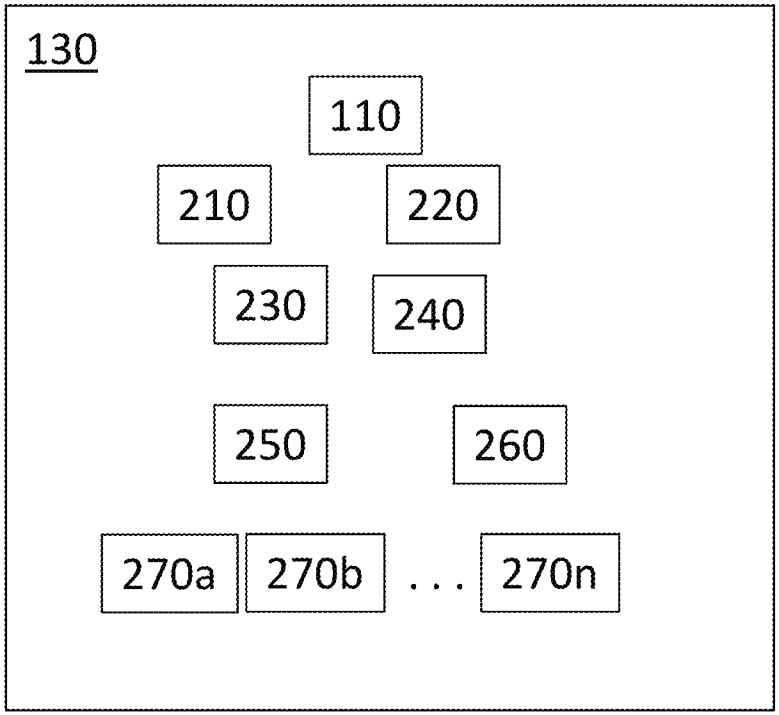
FIG. 2 is a block diagram of components in the flag housing shown in FIG. 1 according to several embodiments.

FIG. 2 is a block diagram of components in the flag housing 130 shown in FIG. 1 according to several embodiments. The flag housing 130, in addition to housing the flag 110, also houses a roller member 210, guide member 220, controller 230, antenna 240, light controller 250, sound system controller 260, and one or more sensors 270. The roller member 210 facilitates rolling of the flag 110 up into the flag housing 130 and out (unfurled) of the flag housing 130. The roller member 210 is a rod, for example. The length of the roller member 210 (along the axial span of the attachment member 120) may be greater than the width of the flag 110 (the portion of the flag parallel with the axial span of the attachment member 120) such that the flag 110 rolls onto the roller member 210. The guide member 220 is positioned at an end of the roller member 210 closest to the top end of the system 100 to keep the flag 110 in alignment with the roller member 210 when the flag 110 is rolled into and out of the flag housing 130. The guide member 220 is detailed with reference to FIG. 3 below.

The controller 230 may include one or more processors and one or more memory devices. The controller 230 is in communication with an antenna 240 to receive remote instructions. The remote instructions may include instructions to roll the flag 110 into or out of the flag housing 130. The remote instructions may also include instructions to move the flag housing 130 along the axial span of the attachment member 120 in some embodiments, as noted above, in conjunction with the holding member 140. The light controller 250 controls the lights 150 on the outside of the flag housing 130. The sound system controller 260 controls sound output from the flag housing 130 and includes one or more speakers. One or both of the light controller 250 and the sound system controller 260 may be integrated with the controller 230 rather than having separate processors (one or more) or memory devices (one or more). One or both of the light controller 250 and sound system controller 260 may include an additional antenna or may be in communication with the antenna 240 in order to receive remote instructions. The antenna 240 may be, for example, an RF antenna. Each of the controllers 230, 250, 260 may operate based not only on remote instructions but also on sensor output from one or more of the sensors 270*a*-270*n*. The sensors 270 may sense one or more of the following: wind, rain, and light. Thus, for example, when rain is detected by a rain sensor 270 or high wind is detected by the wind detector 270, the controller 230 may roll up the flag 110 to prevent weathering and damage. As another example, based on various sensor 270 outputs and remote instructions, the flag may be unfurled and flown at half-mast with the lights on and with music playing. As yet another example, the United States flag may be displayed twenty-four hours a day if it is properly illuminated during the hours of darkness. Thus, the lights 150 may be controlled (by the controller 250) to turn on and illuminate the flag when a sensor 270 (a light sensor) detects the absence of light. The controllers 230, 250, 260 and sensors 270 may be powered by batteries, solar power, or by a combination of power sources. For example, a battery pack may be included in the flag housing 130. More than one power source may be used, as well.

Figure 3:
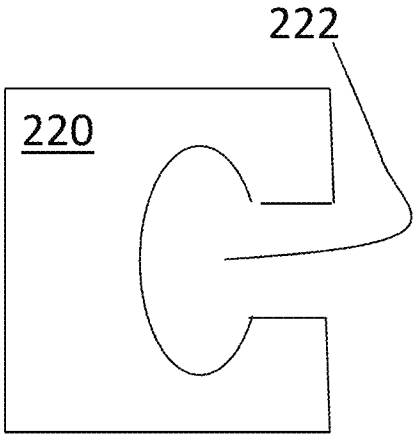
FIG. 3 illustrates details of the guide mechanism shown at FIG. 2 according to an embodiment.

FIG. 3 illustrates details of the guide member 220 shown at FIG. 2 according to an embodiment. The guide member 220, coupled to the roller member 210 at the top end of the system 100 has a notched portion 222 that works to hold the flag 110 in place when it is being rolled into and out of the flag housing 130. The need for the guide member 220 is clear when two different scenarios are considered. First, when the attachment member 120 is affixed to a structure at ninety degrees (the attachment member 120 is perpendicular to a wall such that the flag 110 hangs straight down), the flag 110 may roll up and down on the roller member 210 without issue. That is, a flag 110 that is hanging straight down is likely to roll onto and off of the roller member 210 without skewing from a given alignment with the roller mechanism 210. However, when the attachment member 120 is then affixed to a structure at forty-five degrees, the flag 110 is no longer hanging straight down. At such an angle, when the flag 110 rolls onto and off of the roller member 210, the flag is likely to lose its alignment with the roller member 210 because flag 110 material is bunching up at the top end of the system 100. This situation is prevented by the guide member 220. By maintaining the seam 115 (FIG. 4) of the flag 110 that contacts the roller member 210 at the top end of the system 100 in the notched portion 222, the flag 110 material at the top end of the system 100 is prevented from bunching and, thereby, losing alignment with the roller member 210.

Figure 4:
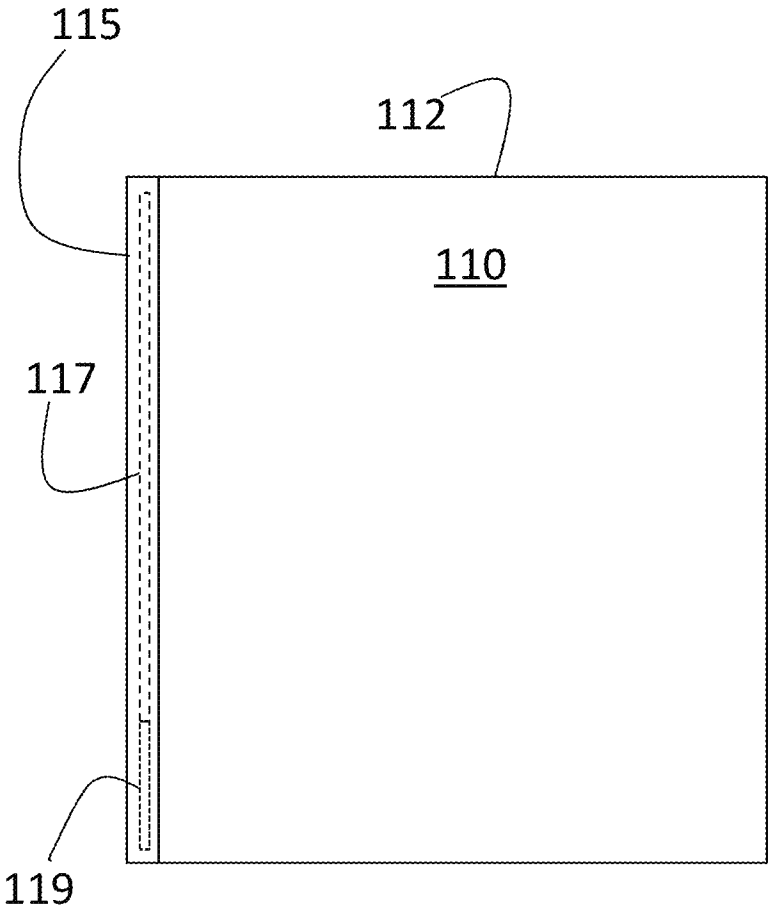
FIG. 4 depicts a flag according to an embodiment.

FIG. 4 depicts a flag 110 according to an embodiment. The seam 115 of the flag 110 that is positioned closest to the top end of the system 100 includes a guide 117 and one or more weights 119. The guide 117 may be, for example, a metal wire with thickness sufficient to keep the seam 115 of the flag 110 in the notched portion 222 (FIG. 3) of the guide member 220. The one or more weights 119 work in conjunction with the notched portion 222 of the guide member 220 to keep the flag 110 in alignment with the roller member 210. The seam 115 with the guide 117 and one or more weights 119 may be integral with the flag 110 or, in alternate embodiments, may be configured as an attachment to any regular flag to form a flag 110 (as shown in FIG. 4). For example, the seam 115 with the guide 117 and one or more weights 119 within it may be configured to be attached via a fabric hook-and-loop fastener, adhesive, pins, or some other method to any flag to be used with the system 100. In the arrangement shown in FIG. 4, the entire span of the top edge 112 of the flag 110 rolls onto the roller mechanism 210 (rod) while the seam 115 is maintained in the notched portion 222 of the guide member 220 that is coupled to the roller member 210 in the flag housing 130.

Figure 5:
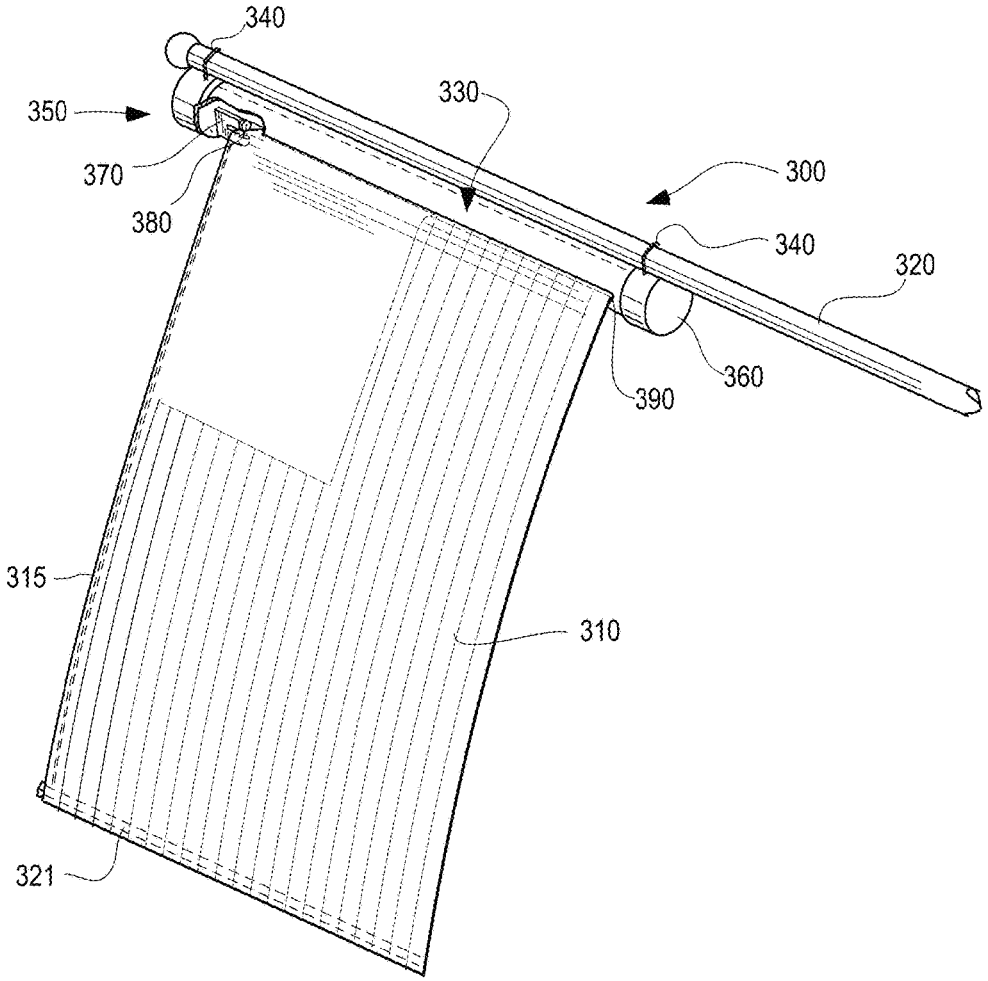
FIG. 5 an embodiment of the present flag system as described herein

FIG. 5 depicts certain elements of a system 300 to display a flag 310 according to an embodiment of the invention. The attachment member 320 affixes the system 300 to a structure (not shown) such as, for example, a building or a ground mount. The attachment portion (not shown, but see for example FIG. 1, attachment portion 122) of the attachment member 320 may pivot in various embodiments to allow attachment of the system 300 at various angles against the structure. For example, a typical arrangement is one in which the system 300 is attached at the attachment portion such that the flag 310 is flying at a forty-five degree angle. Other arrangements include any such arrangements where system 300 is attached at the attachment portion such that the flag 310 is flying at any angle in between but not including horizontal and vertical, or any specific sub range in between horizontal and vertical, or combination or sub-combination of ranges thereof. The attachment member 320 in the embodiment of FIG. 5 is essentially a rod with a base (such as for example, attachment portion 122) that serves as the point at which the attachment member 320 is affixed to the structure. Exemplary types of fasteners to affix the attachment member 320 to a building or other structure include screws, nails, and adhesives. The attachment member 320 is coupled to a flag housing 330 that houses the flag 310.

The flag housing 330 is configured to move along the axial span of the attachment member 320 as indicated by the arrows in FIG. 1. The movement may be achieved manually through adjustment of a holding member 340. The holding member 340 may be, for example, a U-bolt that can be loosened to allow movement of the flag housing 330 and then re-tightened. Exemplary holding members include loops through which the attachment member may be inserted. The loops or other holding member elements may be adjustable to allow repositioning the of the flag housing along the attachment member's longitudinal axis. In alternate embodiments, electronic control may be employed to move the flag housing 330 along the axial span of the attachment member 320. For example, this may be achieved in some embodiments by a gear and track system, a pulley-type system or halyard system, each with assistance of a drive motor. These kinds of longitudinal systems for movement of flags or other species along a longitudinal path are known to those of ordinary skill in the art. The motor may be connected directly to an AC power source or DC power source such as a battery or rechargeable battery. The battery may be conveniently stored within the interior of the roller used to store the flag. This electronically controlled movement may be achieved through a push of a button by an operator or via a remote instruction in various embodiments. By the various embodiments of the holding member 340, the flag 310 may be flown at half-mast (i.e., flag housing 330 is half way between the attachment portion 322 and the other end of the attachment member 320, referred to herein as the top end 350 of the system 300) or at full-mast (i.e., flag housing 330 at the top end 350 of the system 300) or in some other position determined by the user. One or more lights may be mounted on the attachment member 320. Alternatively, an end plate 540 may be fashioned (see FIG. 9) for use as a holding member 340, the end plate defining a small opening 550 for the top end of the roller member 410 and a larger off-center opening 560 through which the attachment member 320 may be passed to assist in supporting the flag housing 330. The end plate is typically attached at the top cud 350 of the flag housing 330. With a few modifications, the end plate may also be affixed to the bottom of the flag housing, if desired, so long as the modification includes an ability to access the drive motor, typically located at or in proximity to the bottom end of the flag housing 330. One or more adjustable stops similar in nature to the U-bolts or loops herein described may be used in conjunction with the one or more end plates to maintain a desired position along the longitudinal axis of the attachment member 310.

Figure 6:
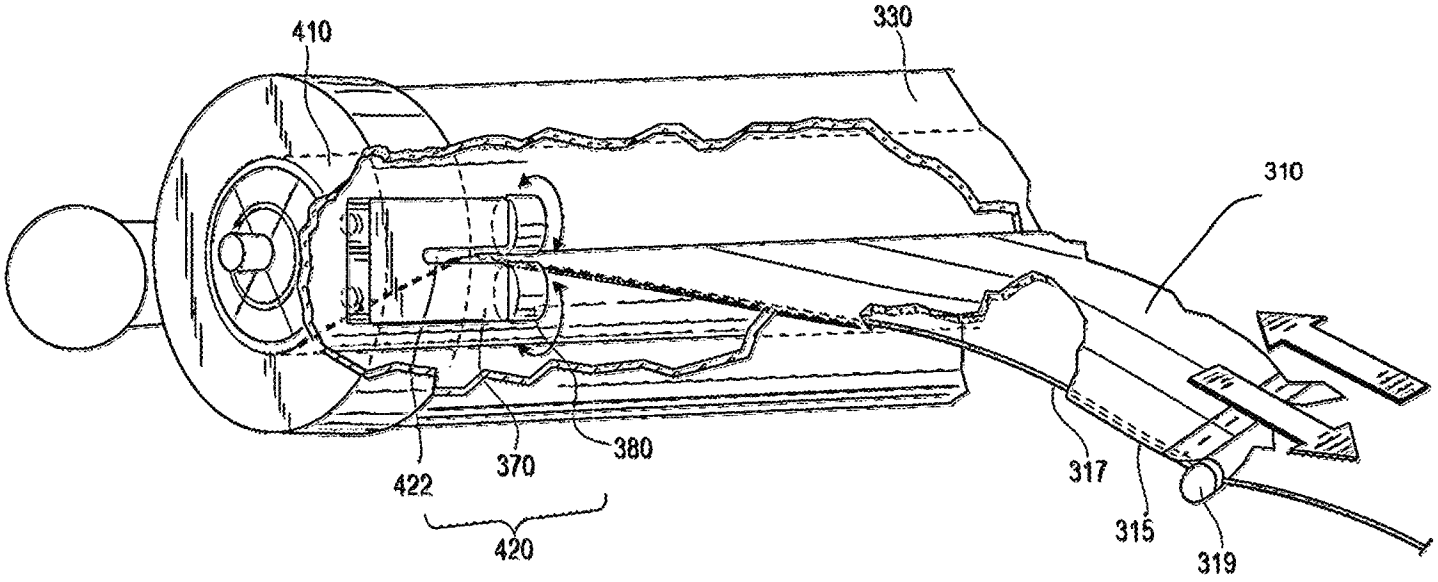
FIG. 6 illustrates details of the guide member mechanism shown at FIG. 5 according to an embodiment.
Figure 7:
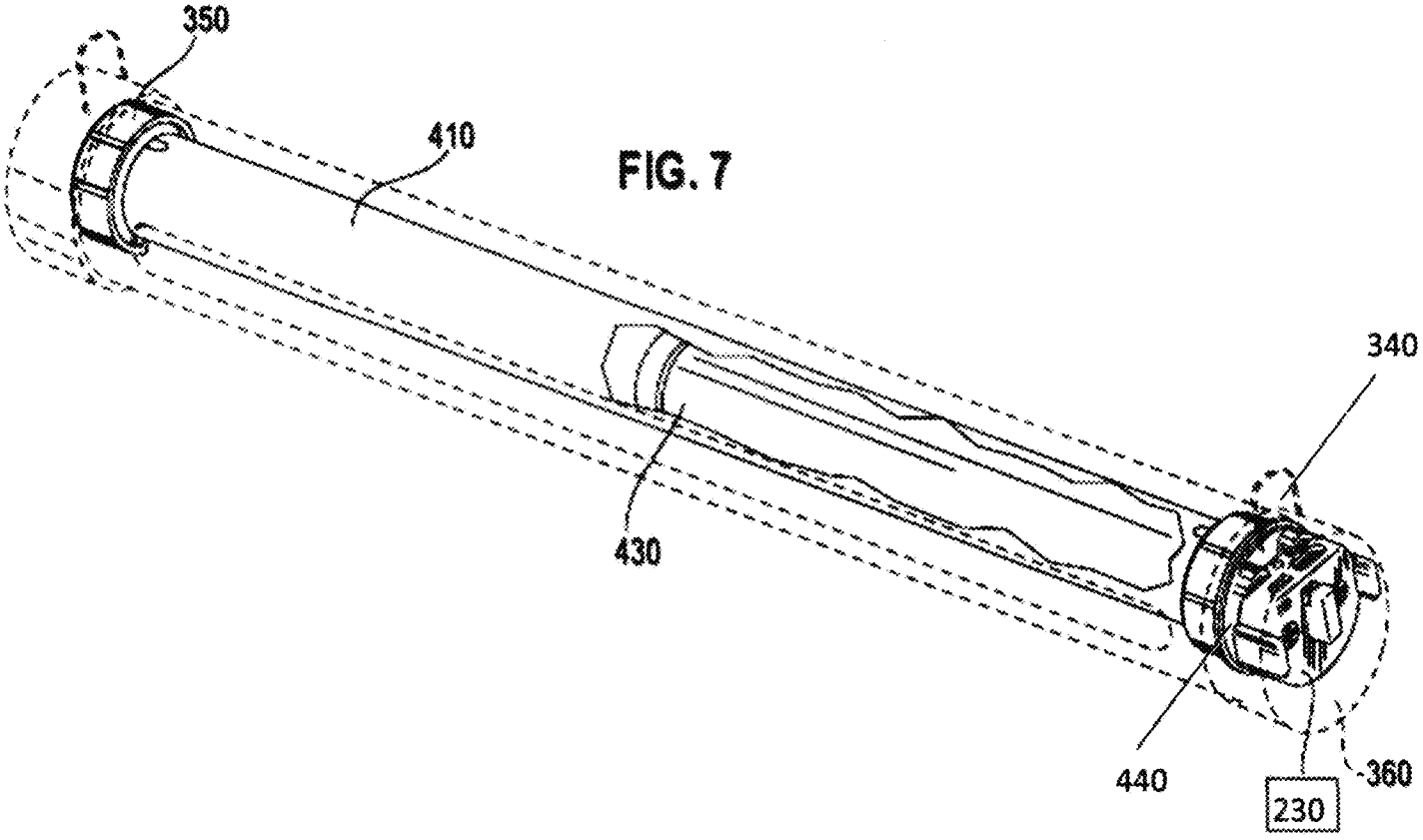
FIG. 7 illustrates some details of the internal workings of the roller member drive mechanism within the flag housing of the present invention.

FIGS. 6 and 7 are breakaway drawings of the exemplary embodiment shown in FIG. 5 for certain components in the flag housing 330 according to several embodiments. The flag housing 330, in addition to housing the flag 310, also houses a roller member 410, guide member 420 (which includes a guide mount 370 and two guide rollers (380), and optionally (see FIG. 2) a controller 230, antenna 240, light controller 250, sound system controller 260, and one or more sensors 270. The roller member 410 facilitates rolling of the flag 310 up into the flag housing 330 and out (unfurled) of the flag housing 330. The roller member 410 is a rod or tube, for example. The length of the roller member 410 (along the axial span of the attachment member 320) may be greater than the width of the flag 310 (the portion of the flag parallel with the axial span of the attachment member 320) such that the flag 310 rolls onto the roller member 410. The guide member 420 is positioned at or in proximity to the end of the roller member 410 closest to the top end 350 of the system 300 to keep the flag 310 in alignment with the roller member 410 when the flag 310 is rolled into and out of the flag housing 330. The guide member 420 is detailed with reference to FIG. 6 below.

The controller 230 may include one or more processors and one or more memory devices. The controller 230 is in communication with an antenna 240 to receive remote instructions. The remote instructions may include instructions to roll the flag 310 into or out of the flag housing 330. The remote instructions may also include instructions to move the flag housing 330 along the axial span of the attachment member 320 in some embodiments, as noted above, in conjunction with the holding member 340. The light controller 250 controls the lights 150 on the outside of the flag housing 330. The sound system controller 260 controls sound output from the flag housing 330 and includes one or more speakers. One or both of the light controller 250 and the sound system controller 260 may be integrated with the controller 230 rather than having separate processors (one or more) or memory devices (one or more). One or both of the light controller 250 and sound system controller 260 may include an additional antenna or may be in communication with the antenna 240 in order to receive remote instructions. The antenna 240 may bc, for example, an RF antenna. Each of the controllers 230, 250, 260 may operate based not only on remote instructions but also on sensor output from one or more of the sensors 270*a*-270*n*. The sensors 270 may sense one or more of the following: wind, rain, and light. Thus, for example, when rain is detected by a rain sensor 270 or high wind is detected by the wind detector 270, the controller 230 may roll up the flag 310 to prevent weathering and damage. As another example, based on various sensor 270 outputs and remote instructions, the flag may be unfurled and flown at half-mast with the lights on and with music playing. As yet another example, the United States flag may be displayed twenty-four hours a day if it is properly illuminated during the hours of darkness. Thus, the lights 150 may be controlled (by the controller 250) to turn on and illuminate the flag when a sensor 270 (a light sensor) detects the absence of light. The controllers 230, 250, 260 and sensors 270 may be powered by batteries, solar power, or by a combination of power sources. For example, a battery pack may be included in the flag housing 330. More than one power source may be used, as well.

FIG. 6 illustrates details of the guide member 420 shown at FIG. 6 according to an embodiment. The guide member 220, comprising a guide mount 370 and two guide rollers 380, coupled to the roller member 410 at the top end of the system 100 has a notched or "U" portion 422 that works to hold the flag 310 in place when it is being rolled into and out of the flag housing 330. The need for the guide member 420 is clear when two different scenarios are considered. First, when the attachment member 320 is affixed to a structure at ninety degrees (i.e, the attachment member 320 is perpendicular to a wall such that the flag 310 hangs straight down), the flag 310 may roll up onto and down from the roller member 410 without issue. That is, a flag 310 that is hanging straight down is likely to roll onto and off of the roller member 410 without skewing from a given alignment with the roller mechanism 410 (i.e., a non-horizontal or non-vertical alignment). However, when the attachment member 320 is then affixed to a structure at, for example, forty-five degrees, the flag 310 is no longer hanging straight down. At such an angle, when the flag 310 rolls onto and off of the roller member 410, the flag is likely to lose its alignment with the roller member 410 because flag 310 material is bunching up at the top end of the system 300. The impact is ameliorated, substantially reduced, limited or prevented by employment of the guide member 420. By maintaining the seam 315 (FIGS. 5 and 6) of the flag 310 that contacts the roller member 410 at the top end 350 of the system 300 in the "U" or notched portion 422 of the guide mount 370, the flag 310 material at the top end of the system 100 is prevented from bunching in proximity to the roller member, and thereby losing alignment with the roller member 210.

FIG. 6 depicts a flag 310 according to an embodiment. The seam 315 of the flag 310 that is positioned closest to the top end 350 of the system 300 includes a guide 317 and one or more weights 319. The guide 317 may be, for example, a metal or nylon wire with thickness sufficient to keep the portion of the seam 315 of the flag 310 containing the guide in the "U" or notched portion 422 of the guide member 420. The one or more weights 319 work in conjunction with the "U" or notched portion 422 of the guide member 420 to keep the portion of the flag 310 in proximity to the guide member and top end of the roller member in alignment with the roller member 410. The seam 315 with the guide 317 and one or more weights 319 may be integral with the flag 310 or, in alternate embodiments, may be configured as an attachment to any regular flag to form a flag 310. For example, the seam 315 with the guide 317 and one or more weights 319 within it may be configured to be attached via a fabric hook-and-loop fastener, adhesive, pins, or some other method to any flag to be used with the system 300. In the arrangement shown in FIG. 6, the entire span of the top edge 315 of the flag 310 rolls onto the roller mechanism 410 (rod or tube) while the seam 315 is maintained in the notched portion 422 of the guide member 420 that is coupled to the roller member 410 in the flag housing 330.

FIG. 7 depicts a breakaway drawing of the roller member 410 for the system shown in FIG. 5. The guide member 420 (not shown) is located at or near the top end 350 of the flag housing 330. At a second end (bottom end) 360 of the flag housing 330 distal to the top end 350, an internal tubular drive motor 440 is located within the roller member 410. This drive motor 440 is employed to rotate the roller member 410 in either direction to furl or unfurl the flag that is attached to the roller member 410. The drive motor 440 may be AC or DC powered. If DC powered, the roller member 410 may include a battery 430 internally (such as a rechargeable battery), sized and fitted for this purpose. The drive motor 440 will necessarily have an on/off mechanism and a directional element (controller 230). These functions may be carried out by manual switches on the face of the drive motor and accessible to the system user by hand, or alternatively by remote control with drive motor systems such as RB22, distributed by Rullo Motorized Systems, Tong Park, Otley Road, Baildon, West Yorkshire BD17 7QD UK. In the event that the system contains a rechargeable battery, a USB port or similar device located on the drive motor face may be used to facilitate recharging of the battery 430

Figure 8:
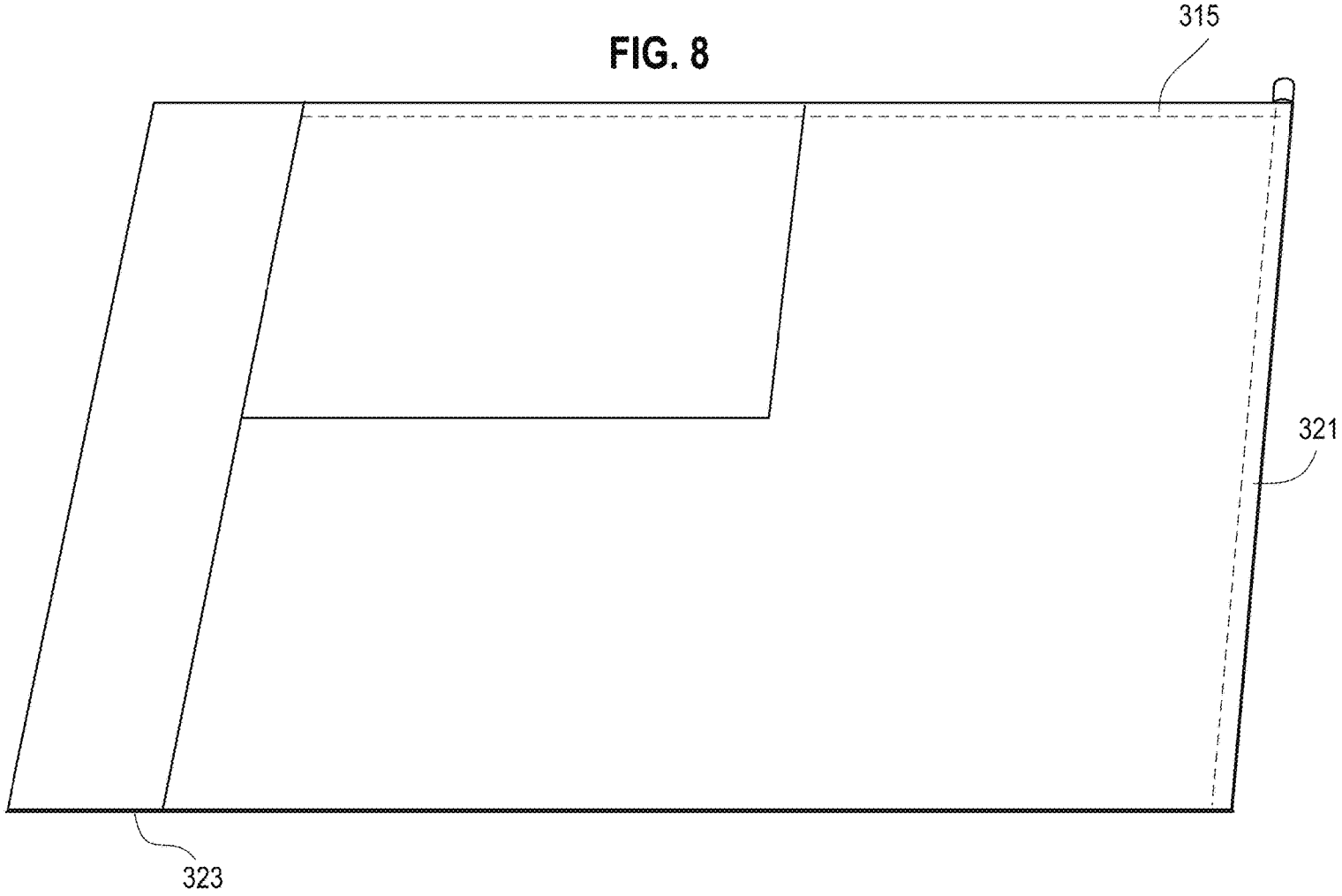
FIG. 8 depicts an exemplary pattern for useful features of a flag that may be utilized in embodiments of the present invention.

FIG. 5 depicts an exemplary flag that has a top seam 315 which may contain a nylon or wire guide to assist furling and unfurling of the flag as it passes through the guide member 420 (combination of "U"-type member 422 as defined by other guide member elements guide mount 370 and guide rollers 380. FIG. 5 also depicts a slot (or opening) 390 in flag housing 330 through which flag 315 is furled and unfurled using the flag system 300. Slot 390 is sufficient length and width to allow free movement of the flag into and out of the housing. The Flag 315 also has an outermost edge 321 that comprises a sleeve or pocket suitable for one or more weights 319 (see FIG. 6), typically a long rod of sufficient heft to keep tension on the guide 317. Tension on the guide 317 by the weight 319, such as a rod, is facilitated by coupling the guide together with the rod. In typical fashion this may be conveniently carried out by having the rod define an orifice at or near seam 315 and threading the guide through or affixing the guide to the rod at this point. See FIG. 6. The flag may be attached to the roller member by any of a number of ways easily recognizable to the skilled artisan once armed with the present disclosure. As an exemplary embodiment, the flag may further comprise an extra portion of cloth 323, typically from about 6" to about 8", or a tubular sleeve made therefrom that is integral with or attached to the flag, such that the roller member may be affixed to the roller or inserted into the tubular sleeve and affixed to the roller member with, for example, double sided adhesive tape or similar product (FIG. 8). The systems of the present invention may or may not include a flag. However, it is readily apparent in view of the disclosure herein that any flag appropriately sized and equipped with the described elements may be employed successfully using the present invention's many embodiments.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system to display a flag, the system comprising:

an attachment member having an attachment portion, the attachment portion configured to affix the attachment member to a structure at an angle in between horizontal and vertical; said attachment member having a first end distal to said structure;

a flag housing configured to house a flag, the flag housing being coupled to the attachment member along a longitudinal axis of the attachment member;

a flag roller member disposed in the flag housing, the flag roller member configured to furl the flag onto and around the flag roller member for storage and unfurl the flag off of the flag roller member for display; and a guide member having a guide mount and including a notched portion and two guide rollers, said guide member coupled to the flag roller member, said guide member positioned at said first end of the flag housing, the guide member being configured to prevent bunching of flag material proximate to said first end and to maintain alignment between the flag and the flag roller member when the flag is rolled onto and off of the roller member.

2. The flag display system according to claim 1, wherein the flag housing has a cylindrical shape with an opening to facilitate the flag movement into and out of the flag housing and onto and off of the flag roller member.

3. The flag display system according to claim 1, further comprising the flag; wherein the flag includes a seam portion along a top side of the flag, and the guide member is configured to maintain the seam portion in alignment with the roller member.

4. The flag display system according to claim 3, wherein the seam portion includes a guide configured to assist the guide member in maintaining alignment of the seam portion with the flag roller member during furling and unfurling of the flag.

5. The flag display system according to claim 4, wherein the flag further comprises one or more weights capable of working in conjunction with the flag seam guide and guide member to maintain alignment between the flag and the flag roller member when the flag is rolled onto and off of the roller member.

6. The flag display system according to claim 1, further comprising a holding member configured to hold the flag housing at a first axial location of the attachment member.

7. The flag display system according to claim 6, wherein the flag housing is configured to allow its movement along the attachment member axis from a first axial location to a second axial location of the attachment member by adjusting the holding member, moving the flag housing along the attachment member longitudinal axis and readjusting the holding member.

8. The flag display system according to claim 7, wherein the flag housing second axial position defines a half-mast position for the flag as displayed.

9. The flag display system according to claim 1, further comprising a controller configured to control the roller member to roll the flag into and out of the flag housing and onto and off of the roller member.

10. The flag display system according to claim 9, further comprising one or more sensors, wherein the controller controls the roller member based on output from the one or more sensors.

11. The flag display system according to claim 1, further comprising at least one of one or more lights affixed to the system and an audio output coupled to the system.

12. The flag display system according to claim 1, wherein the attachment member portion is configured to affix the attachment member to the structure at an angle of 45 degrees.

13. A method to manufacture a flag display system, the method comprising:

coupling a flag housing to an attachment member, the attachment member including an attachment portion configured to affix the attachment member to a structure at an angle in between horizontal and vertical, said flag housing having a first end distal to the attachment portion being disposed at an opposite end of the attachment member from the first end of said flag housing;

disposing a flag roller member in the flag housing, the flag roller member configured to furl and unfurl a flag into and out of the flag housing; and positioning a guide member having a guide mount including a notched portion and two guide rollers at said first end of the flag housing, the guide member being coupled to the flag roller member, the guide member being configured to prevent bunching of flag material proximate to said first end and to maintain alignment between the flag and the flag roller member when the flag is rolled onto and off of the flag roller member; and manufacturing a flag seam with a guide in the flag seam, the flag seam configured to attach to or be integrated with a top side of a flag and be maintained in alignment with the roller member by the guide member when the flag is rolled onto and off of the roller member.

14. The method according to claim 13, further comprising coupling a controller to the flag roller member.

15. The method according to claim 14, further comprising coupling an antenna to the controller to receive a remote instruction, wherein the controller is configured to roll the flag roller member based on the remote instruction.

16. The method according to claim 14, further comprising coupling one or more sensors to the controller, wherein the controller is configured to roll the flag roller member based on an output of the one or more sensors.

17. The method according to claim 13, further comprising coupling at least one of one or more lights or an audio system to the attachment member.

18. The method according to claim 13, wherein the attachment member portion is configured to affix the attachment member to the structure at an angle of 45 degrees.

19. The method according to claim 13, further comprising, disposing a holding member to hold the flag housing at a position along the attachment member longitudinal axis.

20. The method according to claim 13, wherein the disposing of the holding member includes configuring the holding member to be loosened and repositioned to facilitate movement of the flag housing along the longitudinal axis of the attachment member.

21. The method according to claim 13, further comprising one or more weights configured to attach to the flag and work in conjunction with the flag seam guide and guide member to maintain alignment between the flag and the roller member when the flag is rolled onto and off of the flag roller member.

* * * * *